United States Patent [19]

de Keizer

[11] 4,345,388

[45] Aug. 24, 1982

[54] METHOD FOR CONTROLLING THE PRODUCTION OF A DREDGING APPARATUS

[75] Inventor: Cornelis de Keizer, Dordrecht, Netherlands

[73] Assignee: IHC Holland N.V., Papendrecht, Netherlands

[21] Appl. No.: 134,477

[22] Filed: Mar. 27, 1980

[30] Foreign Application Priority Data

Mar. 27, 1979 [NL] Netherlands ..... 7902381

[51] Int. Cl.[3] ..... E02F 3/88

[52] U.S. Cl. ..... 37/195; 37/58; 37/DIG. 1

[58] Field of Search ..... 37/195, DIG. 1, 58, 37/64–67

[56] References Cited

U.S. PATENT DOCUMENTS 3,380,179 4/1968 Schmidt ..... 37/67 X

FOREIGN PATENT DOCUMENTS 1658028 4/1971 Fed. Rep. of Germany .
6607591 12/1967 Netherlands .
6712405 5/1968 Netherlands .
1130436 10/1968 United Kingdom ..... 37/58
502100 8/1976 U.S.S.R. ..... 37/DIG. 1

*Primary Examiner*—Clifford D. Crowder
*Attorney, Agent, or Firm*—Young & Thompson

[57] ABSTRACT

A method for controlling the production of a dredging apparatus such that the highest possible concentration of the mixture is obtained, by using for controlling the dredger, the difference between the forces occurring at the dredging implement and the forces occurring upon maximum concentration. The value of that maximum force, which depends on the dredging conditions, is continuously adapted to the ratio between the existing concentration and the existing loosening force in order to obtain an immediate response to changing conditions during dredging.

2 Claims, 3 Drawing Figures

METHOD FOR CONTROLLING THE PRODUCTION OF A DREDGING APPARATUS

The invention related to a method of controlling the production of a dredging apparatus by controlling the concentration of the mixture so that the desired maximum concentration is approached as closely as possible.

A method of this kind is generally known. During dredging operations it is important to obtain the highest possible production. This means that with the chosen dredging implement the largest possible quantity of soil with the smallest quantity of water i.e. a mixture of the highest concentration, has to be aimed at. If the dredging apparatus is a bucket dredger, the degree of filling of the buckets (which can be seen visually) is controlled by controlling the cutting depth.

If the apparatus is a cutter suction dredger or a dredging apparatus having a digging wheel and suction conduit, the concentration is measured in the suction conduit and the signal obtained there is used to adjust the cutting depth.

All three types of dredger have a common problem in that the visual observation or the measuring signal is considerably delayed with regard to the actual situation at the location of the digging or cutting apparatus itself. This means that the control hunts, which not only is disadvantageous for optimum production but also gives rise to erroneous controlling movements. The latter can occur, for instance, if the measuring signal demands an increase of the cutting depth at a moment when this is no longer desired or is even disadvantageous.

The purpose of the invention is to improve this situation.

In the invention this purpose is achieved by measuring the difference between one or more of the loosening forces (F) occurring at the location of the digging or cutting apparatus and the maximum forces ($F_{max}$) occurring at maximum concentration.

The invention starts from the premise that the product of the dredging apparatus has a direct relation to the force or forces necessary to loosen the soil. Thus with a bucket dredger the loosening force will be related to the force necessary to move the buckets as well as to the horizontal tension in the cable or cables by means of which the bucket dredger is displaced. There also exists a relation between the loosening forces and the stress in the material of the ladder.

Similarly, in a cutter suction dredger the loosening force is related to the torque occurring at the cutter head as well as to the horizontal tension in the cables which displace the cutter head. With a digging wheel there also exists a relation between the torque at the digging wheel and the required horizontal tension. There also exists a relation between the loosening forces and the stress in the material of the suction tube or ladder.

The above force or forces can be measured immediately and can be used for controlling purposes with no time delay. If the measurement of the force(s) is presented by means of display instruments then at worst the time constant that is required to obtain a stable indication has to be dealt with. The delay introduced by this time constant is, however, small—much smaller than the delay in measuring the concentration, which often occurs many tens of meters away from the cutting implement.

If the dredging apparatus under consideration is one in which control of production is achieved by comparing the measured value of the concentration in the suction tube (necessarily delayed because of the distance of the point of measurement from the suction mouth, as mentioned above) with a set-point in order to generate a control signal, then according to the invention it is possible continuously to adapt the limit of the maximum force (which varies as dredging conditions change) to the ratio between the measured concentration or production and the measured force.

It is apparent then, that in place of a slow and often unstable control scheme using the concentration, a fast control scheme using the instantaneous loosening forces is possible. This arrangement at the same time allows adaptation of the maximum permissible force depending on dredging conditions, by comparing the measured concentration with the measured force at the same moment. The measurement of the concentration is still delayed, in fact, but the measurement of the loosening force is artificially delayed by the same amount of time so that the direct relation between the loosening force and the production is correctly defined. The calculated relationship between concentration and the loosening force is used to give an estimate of production without a delay, which can be used to permit rapid control in a manual system.

The invention will now be further elucidated with reference to a number of diagrams. In the drawings.

Figure 1:
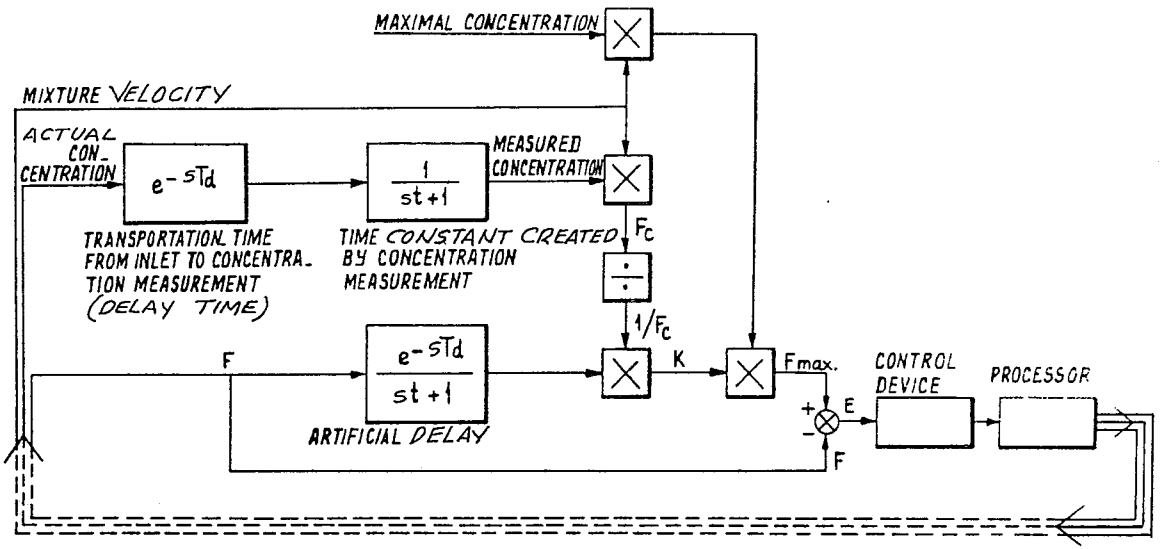
FIG. 1 shows a block diagram to illustrate the principle of the control according to the invention.

In a suction dredger the relationship between concentration and production is defined by the equation:

$$\text{ti Production} = \text{concentration} \times Vm \times \text{surface} \quad (1)$$

The concentration is defined by:

$$\text{Concentration} = (Y_m - 1)/(Y_s - 1) \quad (2)$$

Where:

Vm: the velocity of the dredged mixture in the conduit.

Surface: the surface of the cross section of the conduit.

$Y_m$: the specific weight of the dredged mixture and $Y_s$: the specific weight of the material of the soil.

For measuring the force, one of the aforementioned possibilities can be chosen, e.g. the tension in a tension cable serving for the advancement of the dredging implement.

The measured value is delayed and filtered in the same way as the signal of the concentration measuring implement according to the Laplace Transforms $e^{-sTd}$ and $1/(s\tau+1)$.

In this formula Td is the transportation time (or delay time) and $\tau$ the constant time factor.

Delay time is the time period which is necessary to transport the soil mixture from suction conduit to the concentration measurement equipment. In control theory it is usual to express said delay time or dead time by means of the formula $e^{-sTd}$.

The formula $1/s\tau+1$ is known also from control theory and represents the filtering (or time constant) of the concentration measurement. With an input value x and an output value y:

$$\frac{y}{x} = \frac{1}{s\tau + 1} s = \frac{d}{dt} \text{ or}$$

$$Y(s + 1) = x \text{ and}$$

$$\frac{dy}{dt} \tau + Y = x \text{ or } \frac{dy}{dt} = \frac{x - y}{\tau}$$

In the measurement of the concentration of the delay time has a large value, of the order of 10 to 20 seconds. The measurement of the force does not have this delay.

The measurement of the concentration delivers a signal which is proportional to the production according to the equation:

$$F_C = V_m \times \text{concentration} \quad (3)$$

As $F_c$ the production can be taken according to equation (1).

Subsequently the quotient of $F_c$ and the measured force F is defined, which quotient (K) gives the ratio between the force F and the concentration or production. With the aid of this, the maximum permissible force $F_{max}$ can be calculated at which the concentration and the production will be at a maximum.

For this the equation which follows is of importance:

$$F_{max} = V_m \times (\text{maximum concentration}) \times K \quad (4)$$

or $$F_{max} = (\text{maximum production}) \times K \quad (5)$$

The difference between the real force F and the maximum force $F_{max}$ can now be used to control the control device of the dredging process such that the force F approaches $F_{max}$ as closely as possible. This can be done by changing the speed of movement of the dredging implement, by increasing or decreasing the depth of dredging and/or by controlling the thickness of the cut.

The ratio K is continuously computed so that the maximum force is continuously adapted to changing dredging conditions such as the hardness of the soil.

The block diagram in FIG. 1 shows at F the input measurement of the existing force, which by means of the Laplace Transform gives a value which is divided by the value $F_c$ of the measured concentration.

The ratio (K) obtained from this is multiplied with the maximal concentration and delivers the maximum force $F_{max}$ which at E at the right side of the diagram is compared with the existing force F and inserted into the control device.

Figure 2:
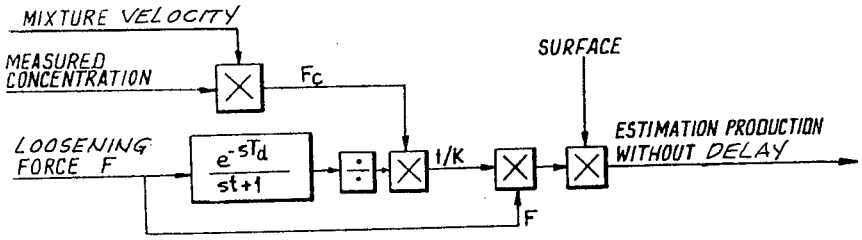
FIG. 2 is a block diagram which shows how production can be estimated.

From the slightly different block diagram of FIG. 2, it further appears that if the existing force F is multiplied by the production signal $F_c$ and divided by the ratio K one obtains a measurement of the production according to the formula:

$$\begin{aligned} \text{Estimated production} &= \text{concentration} \times \text{mixture velocity} \\ &\times \text{surface} \times f/K \\ &= Fc \times F/K \end{aligned} \quad (6)$$

Figure 3:
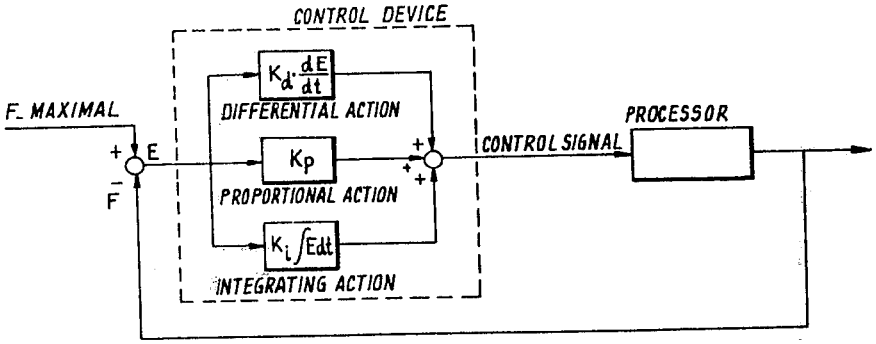
FIG. 3 shows a block diagram for obtaining a control signal.

FIG. 3 further illustrates that this error signal E, which is the difference between $F_{max}$ and F, through a proportional integrating and differentiating control device (a so-called P.I.D. control device) can be translated into a control signal which may serve to control, for example, the speed of revolution of the holding side winch.

For measuring the loosening forces F, use can be made of the measurement of the motor current in an electric motor or of the liquid pressure in a hydraulic motor. This can take place at the motor of the cutter and at the motor of the winch. Magnitude of current or liquid pressure respectively form a factor having a direct relationship to the power being delivered by the motor.

I claim:

1. A method of dredging, comprising moving a dredging instrument in contact with submarine soil with sufficient force to loosen said soil, removing said loosened soil in admixture with water from the dredging face, determining the maximum possible concentration of said mixture, determining the maximum force with which said soil resists the dredging operation corresponding to said maximum concentration, continuously determining the actual force with which said soil resists the dredging operation, continuously determining the difference between said maximum force and said actual force, and continuously changing the dredging conditions so as to reduce said difference.

2. A method as claimed in claim 1, in which said mixture is removed from the dredging face through a suction tube, measuring the acutal concentration of the mixture in the suction tube, measuring the actual force with which said measured mixture in the suction tube was loosened, and continuously redetermining said maximum force as a function of said actual concentration and its associated said loosening force.

* * * * *